US006520372B2

(12) United States Patent
Phelps

(10) Patent No.: US 6,520,372 B2
(45) Date of Patent: Feb. 18, 2003

(54) FOLDED SHEET DISPENSER HAVING AN OVERFILL PREVENTION DEVICE

(75) Inventor: Stephen L. Phelps, Lilburn, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 26 days.

(21) Appl. No.: 09/741,267

(22) Filed: Dec. 19, 2000

(65) Prior Publication Data

US 2002/0074340 A1 Jun. 20, 2002

(51) Int. Cl.[7] ..... B65H 1/00

(52) U.S. Cl. ..... 221/34; 221/45; 221/54; 221/62; 312/60

(58) Field of Search ..... 312/60; 221/34, 221/45, 52, 53, 54, 56, 57, 62

(56) References Cited

U.S. PATENT DOCUMENTS

| | | | | |
|---|---|---|---|---|
| 1,944,431 A | * | 1/1934 | Hope et al. | 312/60 |
| 2,027,674 A | * | 1/1936 | Broeren | 221/62 |
| 2,426,787 A | | 9/1947 | O'Neil | |
| 3,341,067 A | | 9/1967 | Bastian | |
| 3,589,555 A | * | 6/1971 | Burkhalter | 221/45 |
| 3,935,965 A | * | 2/1976 | Stevens | 221/45 |
| 4,469,243 A | * | 9/1984 | Ito et al. | 221/34 |
| 4,838,454 A | | 6/1989 | Salzmann et al. | |
| 4,938,382 A | | 7/1990 | Frazier et al. | |
| 5,076,466 A | | 12/1991 | Petterson et al. | |
| 5,716,691 A | | 2/1998 | Chan | |
| 5,884,805 A | | 3/1999 | Tramontina | |

FOREIGN PATENT DOCUMENTS

| | | |
|---|---|---|
| EP | 0061589 | 10/1982 |
| EP | 0506243 A1 | 9/1992 |
| WO | 9840002 | 9/1998 |

OTHER PUBLICATIONS

EPO Search Report, dated May 31, 2002.

* cited by examiner

*Primary Examiner*—H. Grant Skaggs
(74) *Attorney, Agent, or Firm*—Dority & Manning

(57) ABSTRACT

A dispenser for dispensing stacked folded sheets includes a housing defining an internal storage space for a supply of folded sheets, for example folded paper towels or tissues. The housing includes a cover member that is movable between an open position and a closed position. An overfill prevention device is configured within the housing and is actuated by movement of the cover from its closed position to its open position. The overfill prevention device reduces the storage space within the housing upon movement of the cover to its open position.

16 Claims, 3 Drawing Sheets

FOLDED SHEET DISPENSER HAVING AN OVERFILL PREVENTION DEVICE

FIELD OF THE INVENTION

The present invention relates generally to the field of folded sheet dispensers.

BACKGROUND OF THE INVENTION

Dispensers for dispensing stacked folded sheets of paper towels and the like are well known in the art. Single sheet dispensers are generally desirable because they can be refilled when only partially depleted, as compared to roll product dispensers wherein changing a partially depleted roll results in significant wasted product. Stacked single sheet dispensers are also desirable because they tend to be simple devices that are not subject to jamming or failure.

A disadvantage of folded stacked sheet dispensers is that they can be overloaded or overfilled. Overfilling the dispenser can create a pressure against the stack of sheets that makes it very difficult to remove a sheet from the dispenser. For example, the pressure against the stack may prevent a "tab" end of the sheet from becoming accessible for a user to grasp in order to withdraw the sheet. In an overfilled condition, the stack of sheets may be wedged in the dispenser so firmly that the portion of the sheet grasped by the user simply tears instead of dispensing the sheet. Friction against the dispensing opening may be increased by overfilling the dispenser making dispensing unreliable and problematic.

U.S. Pat. No. 5,884,805 assigned to Kimberly-Clark Corporation proposes one solution for preventing overfilling of stacked folded sheet dispensers. With the dispenser according to the '805 patent, an overfill bracket is moveably connected to the frame of the dispenser such that an overcapacity of folded sheets in the frame displaces the overfill bracket and prevents the dispenser cover from engaging the frame.

Although the '805 patent provides one solution, there is still a need in the art for improvements in stacked folded sheet dispensers for preventing overfill conditions.

SUMMARY OF THE INVENTION

Objects and advantages of the invention will be set forth in part in the following description, or may be obvious from the description, or may be learned through practice of the invention.

According to the present invention, a dispenser is provided for dispensing stacked folded sheets, such as paper towels, tissues, and the like. It should be appreciated, that the dispenser is not limited by its overall shape or appearance and the present invention may be incorporated into any type or configuration of folded sheet dispenser.

The dispenser includes a housing that is configured to hold a supply of stacked folded sheets in an internal storage space. The housing includes a back panel and a bottom portion and has at least one dispensing opening defined therein. The housing also includes a cover member pivotally attached to stationary components of the housing. The dispensing opening may be in the bottom portion of the housing or the cover member. The cover member is moveable between an open position wherein access is provided to the storage space for refilling the folded sheets, and a closed position wherein the cover defines a front panel of the dispenser.

An overfill prevention device is configured within the housing and is actuated by movement of the cover from the closed position to the open position. The overfill prevention device reduces the storage space for folded sheets in the housing when the cover member is moved to its open position.

In one embodiment of the invention, the overfill prevention device comprises a bottom member, such as a plate member, against which the folded sheets are stacked. The bottom member is moveably mounted within the housing and is movable from a position generally adjacent the dispensing opening in the housing when the cover member is in its closed position, to a position vertically displaced from the dispensing opening when the cover member is in its open position. A motive member, such as a mechanical cam, is configured between the cover member and the bottom member so that the bottom member is moved to its vertically displaced position upon a maintenance technician opening the cover member to refill the dispenser with stacked folded sheets.

When the technician moves the cover member to the open position and the bottom plate member is moved vertically upwards relative to the dispensing opening, a "protective" space or gap is defined between the bottom portion of the housing and the bottom plate member against which the folded sheets are stacked. This gap acts as a protective buffer. Regardless of the number of sheets stacked on the bottom member, once the cover is closed, the bottom member moves vertically downward, and the gap or buffer then becomes part of the storage space for the stacked sheets. Thus, even if the stacked sheets are overfilled by the technician, any overfill pressure is relieved once the bottom member moves vertically downward upon closing the cover member.

The bottom member has an opening therethrough that is aligned with the dispensing opening in the housing. This opening is preferably larger than the dispensing opening in the bottom portion of the housing.

The motive member, such as the mechanical cam, operatively configured between the cover member and the bottom member includes a cam surface disposed so as to contact and move the bottom member vertically upward upon opening of the cover member. The cam surface can have various shapes and configurations. For example, the cam surface may have an eccentric shape so that the bottom member is held and maintained in its vertically displaced position upon the full opening range of the cover member. In one particular embodiment of the invention, the cam member is an elongated tab having a generally semicircular end defining the cam surface that engages against and lifts the bottom member upon opening the cover member.

It may be desired that more than one cam member be provided. For example, the cover member may be pivotally attached at opposite side panels to the housing. A cam member may be disposed at each pivotal connection. Cam members are disposed generally below side portions of the bottom plate member. Upon pivotal movement of the cover member to its open position, the cam surfaces engage against the bottom of the bottom plate member and move the plate member vertically upwards.

The invention is not limited to a particular type of motive member configured between the bottom plate member and the cover member. A simple mechanical cam may be desired for its simplicity and ease of manufacture. However, other motive devices are within the scope of the invention. For example, levers, wires or cables, etc. may be utilized to move the bottom plate member upon movement of the cover member between its open and closed positions.

It should also be appreciated that the overfill prevention device according to the invention may be utilized in any configuration or style of folded sheet dispenser.

The invention will be described in greater detail below with reference to an embodiment of the invention illustrated in the figures.

DETAILED DESCRIPTION

Figure 1:
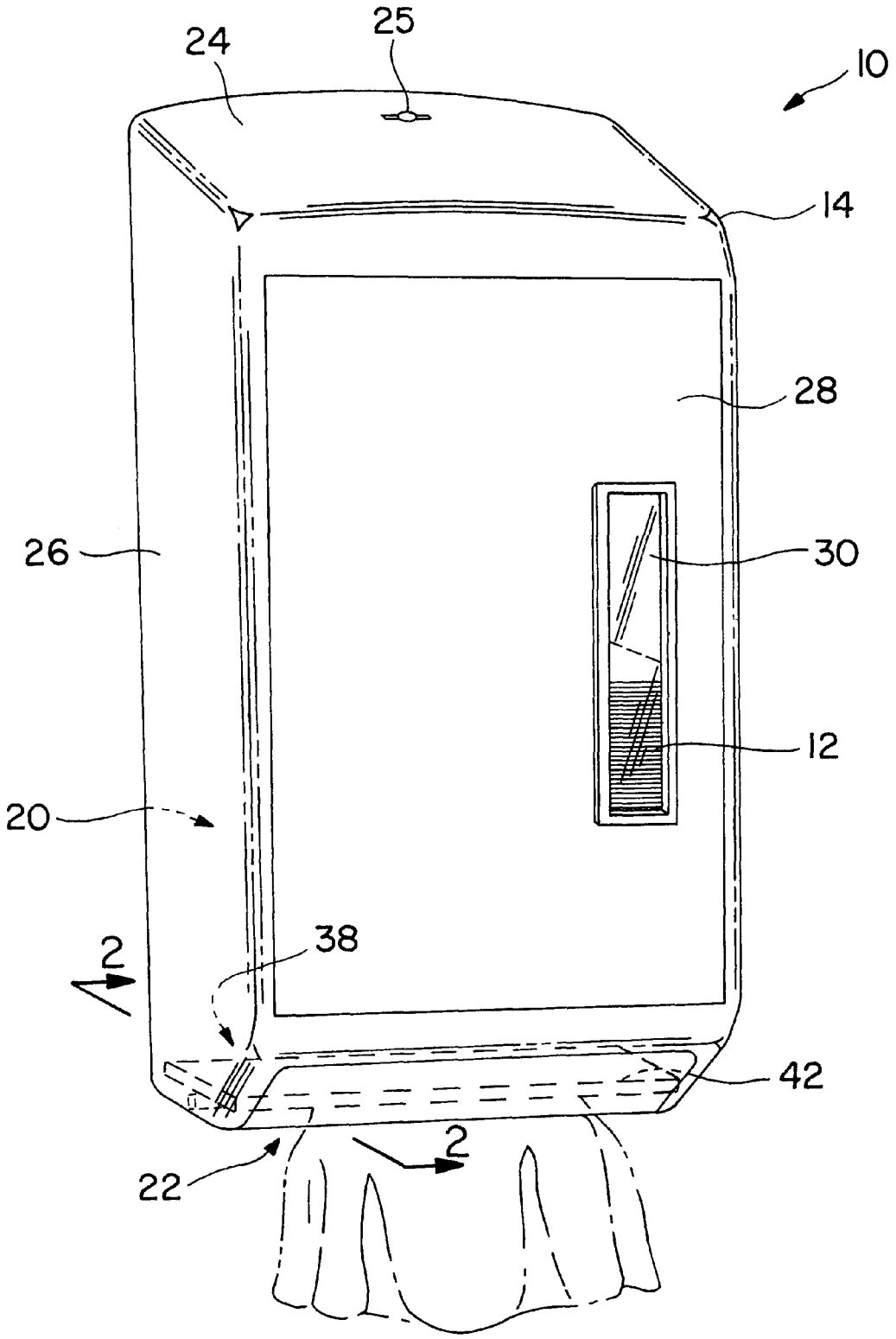
FIG. 1 is a perspective view of a dispenser in accordance with the present invention.

Reference will now be made in detail to embodiments of the invention, examples of which are illustrated in the drawings. Each example is provided by way of explanation of the invention, and not as a limitation of the invention. For example, features illustrated or described as part of one embodiment, can be used with another embodiment, to yield still a further embodiment. It is intended that the present invention include modifications and variations to the embodiments and examples described herein as come within the scope and spirit of the invention.

Referring to the figures in general, a dispenser 10 according to the invention is illustrated. The dispenser 10 is configured for dispensing stacked folded individual sheets 12. The dispenser 10 is particularly suited for dispensing paper towels, tissues, and the like. However, it should be appreciated that a dispenser according to the invention is not limited in this regard. The dispenser will be described herein as it relates to a paper towel dispenser for clarity and ease of explanation.

It should also be appreciated that a dispenser according to the invention is not limited in its overall shape or configuration. For example, the dispenser illustrated in FIG. 1 has the overall shape and configuration of a dispenser provided by Kimberly-Clark Corporation and identified as an INTERLEAVED BATHROOM TISSUE DISPENSER (Item No. 74406). This particular dispenser is illustrated merely as an example of one embodiment of a dispenser incorporating the unique features of the present invention.

The dispenser 10 includes a housing 14 that is configured to hold a supply of folded sheets 12 in an internal storage space 20 defined within the housing 14. The housing 14 may include a back panel 16, a bottom panel or portion 18, and a cover 24. The housing 14 may be formed of any suitable materials.

The cover 24 is attached to the stationary components of the housing, for example the bottom panel 18 or back panel 16, and is movable to an open position wherein access is provided to the internal storage space 20 for loading additional folded sheets 12. The cover 24 is shown in its closed position in FIG. 1 wherein the cover defines a front panel 28 of the dispenser 10. The cover 24 is releasably engaged with the stationary components of the housing by way of any conventional locking device 25.

The housing 14 includes at least one dispensing opening through which the folded sheets are dispensed from the internal storage space 20. In the illustrated embodiment, the dispensing opening 22 is defined in the bottom panel 18 of the housing. This is not a limitation of the invention. For example, the dispensing opening 22 could also be defined in a bottom portion or panel member of the cover 24. The dispensing opening 22 may be disposed in any convenient location for a user to pull and dispense the individual folded sheets from the housing 14.

The cover 24 may be pivotally attached to a stationary component of the housing 14. For example, in the illustrated embodiment, the cover 24 is pivotally attached to the bottom panel 18 by way of pivotal mounts 32. Any conventional pivotal attaching mechanism may be used in this regard. For example, in the illustrated embodiment, a simple rotatable rod 34 is provided and retained by rod holders 36. The cover member 24 includes side panels 26 that are rotationally fixed to the rod 34 by any convenient attachment means. It should be appreciated that any number of conventional pivotal arrangements are known by those skilled in the art that may be utilized to pivotally mount the cover member 24.

A dispenser 10 according to the invention also includes an overfill prevention device, generally 38, configured within the housing 14. The overfill prevention device 38 is actuated by movement of the cover 24 from its closed position illustrated in FIG. 1 to its open position illustrated in FIG. 3. The overfill prevention device 38 reduces the internal storage space 20 within the housing 14 upon opening of the cover 24 and thus creates a gap or buffer 43 within the internal storage space 20, as particularly illustrated in FIG. 3.

Figure 2:
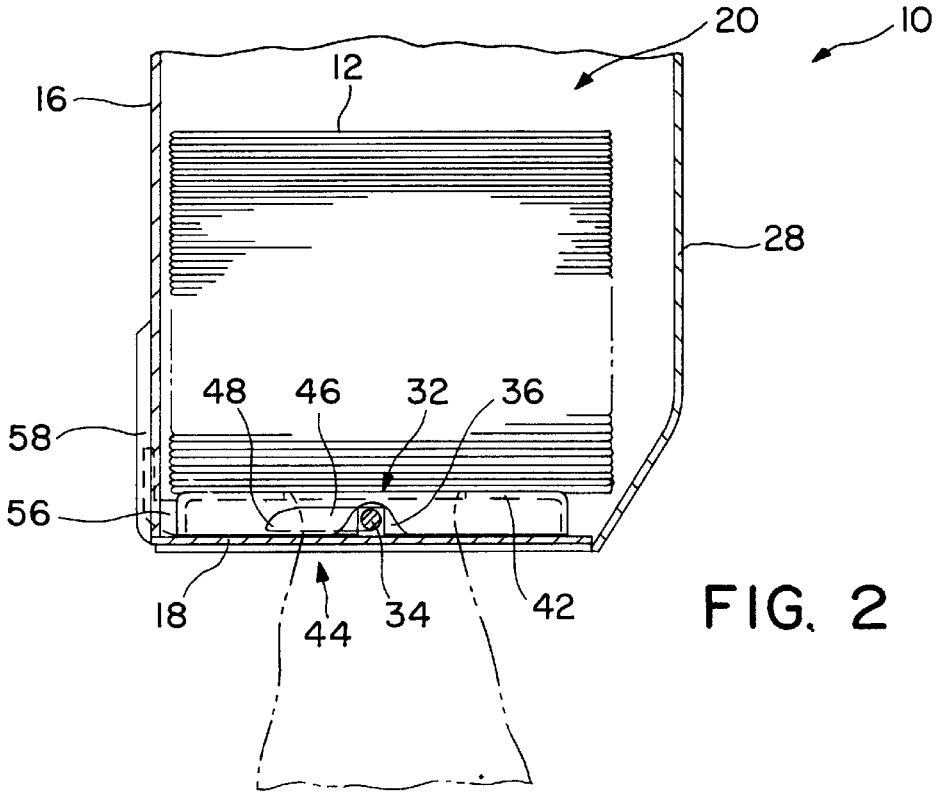
FIG. 2 is a cross-sectional view of the dispenser illustrated in FIG. 1 taken along the lines indicated.
Figure 3:
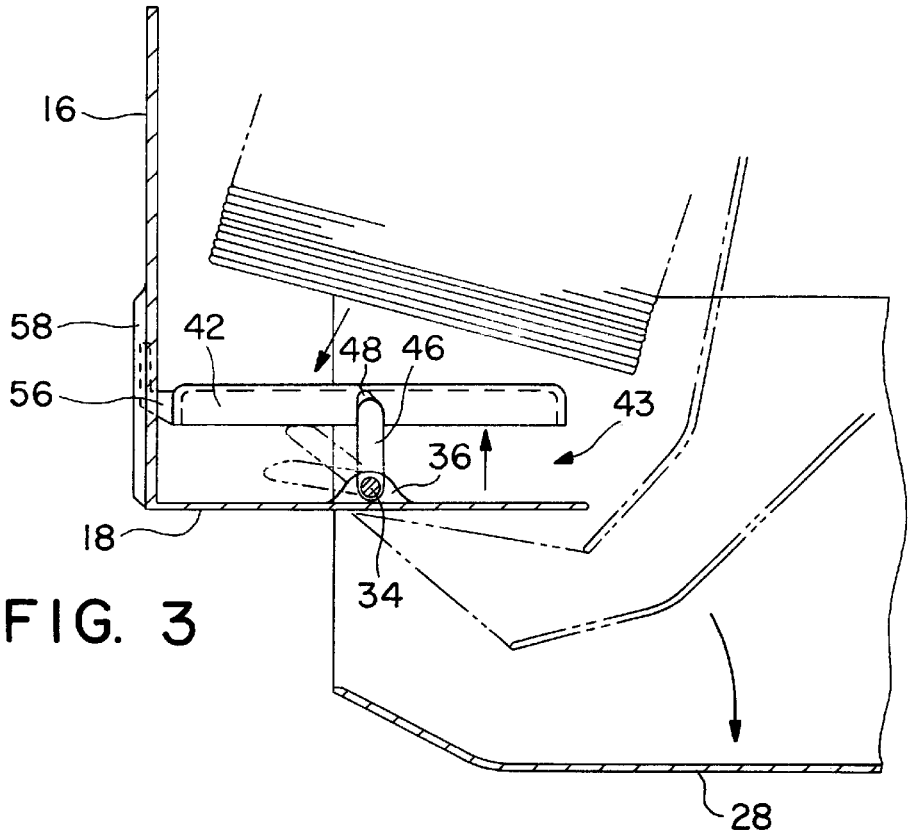
FIG. 3 is a cross-sectional and partial operational view of the dispenser illustrated in FIG. 2.

Referring to FIG. 3, an embodiment of the overfill prevention device 38 includes a bottom member, for example a bottom plate 42, against which the folded sheets 12 are stacked, as particularly illustrated in FIG. 2. The bottom member 42 is movably mounted within the housing 14 and moves from a position generally adjacent to the dispensing opening 22 when the cover 24 is in its closed position, as illustrated in FIG. 2, to a position that is vertically displaced from the dispensing opening 22 when the cover 24 is in its open position, as particularly illustrated in FIG. 3. A motive member is operatively configured between the cover 24 and the bottom member 42 to move the bottom member to the position illustrated in FIG. 3 upon movement of the cover 24 to its open position.

In the illustrated embodiment, the motive member is a cam member 46 that is rotationally fixed relative to the cover member 24 so that as the cover member pivots or moves to its open position, the cam 46 also moves accordingly. The cam member 46 includes a cam surface 48 that engages against the bottom member 42 causing vertical displacement of the bottom member as the cover 24 is moved to its open position. In the illustrated embodiment, the cam 46 is a relatively simple elongated tab member having a generally curved cam surface 48 that engages against the bottom member 42. The cam 46 has an overall length that dictates the vertical displacement of the bottom member 42. It should be appreciated that the cam 46 may take on any shape or configuration. For example, in an embodiment not illustrated in the figures, the cam 46 may have an eccentric shape so that the vertically displaced position of the bottom member 40 is held relatively constant as the cover member moves from the open to closed position. Any and all such configurations of a cam are within the scope and spirit of the invention.

It should also be appreciated that the cam configuration illustrated and described herein is a relatively simple embodiment of a motive member 44 that may be used to cause vertical displacement of the bottom member 42. The invention is not, however, limited to a cam configuration. For example, any configuration of levers, cables, jacks, piston and cylinder arrangements, etc., may be utilized to move the bottom member 42 upon opening of the cover member 24. Those skilled in the art can easily design any number of mechanical configurations for achieving this purpose.

Figure 4:
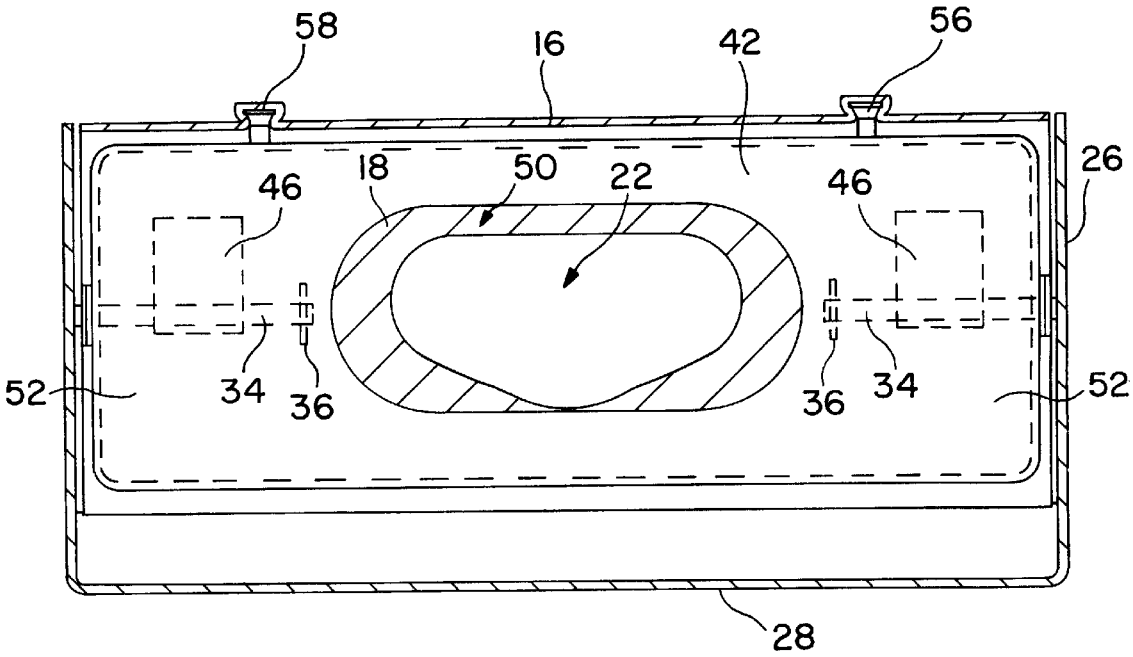
FIG. 4 is a top cross-sectional view of the dispenser particularly illustrating the overfill prevention device.

Referring to FIG. 4, the cam 46 is disposed below a side portion 52 of the bottom member 42. The cam 46 is rotationally fixed to the pivot rod 34 and thus moves as indicated in FIG. 3 upon opening of the cover 24. It may be desired to provide an additional cam 46 under the opposite side portion 52, as illustrated in FIG. 4, to ensure even and smooth displacement of the bottom member 42.

The bottom member 42 also includes an opening 50 defined therethrough that overlays the dispensing opening 22, as particularly illustrated in FIG. 4. To ensure that the bottom member 42 does not inhibit dispensing of the folded sheets 12, it may be desired that the opening 50 is dimensionally larger than the dispensing opening 22. Referring to FIG. 2, it is desired that the bottom member 40 is disposed essentially directly adjacent to the dispensing opening 22 when the cover 24 is in its closed position. The depth of the bottom member 42 may be limited as necessary. In this regard, the shape of the cam 46 is also relevant. The cam 46 should have a shape so as to permit the bottom member 40 to lie relatively close to the dispensing orifice 22 in the closed position of the cover. An elongated tab configuration of the cam 46 is particularly useful in this regard.

The bottom member 42 may also be slidably engaged relative to a stationary component of the housing 14 to lend rigidity and support to the overall configuration of the dispenser 10. In the illustrated embodiment, this is achieved by way of tabs 56 extending from the back of the bottom member 42 into recesses 58 defined in the back panel 16 of the housing 14.

In order to refill the dispenser 10, a maintenance technician unlocks and moves the cover 24 to its open position, as illustrated in FIG. 3. This action causes the bottom member 42 to move vertically upwards, as described above. The maintenance technician then places the stacked folded sheets 12 onto the bottom member 42. The maintenance technician may attempt to overfill the dispenser 10 by compressing and loading as many of the sheets as possible into the internal storage space 20 while still allowing the cover 24 to close. However, once the cover 24 is moved to the closed position, the bottom member 42 moves vertically down to the position illustrated in FIG. 2. Thus, the buffer space 43 created by the vertical upward displacement of the bottom member 42 becomes available as additional storage space and the compression of the stacked sheets 12 caused by the initial overfill condition is relieved. The sheets are allowed to "expand" within the additional space and are subsequently easily pulled and dispensed from the dispenser 10.

Figure 5:
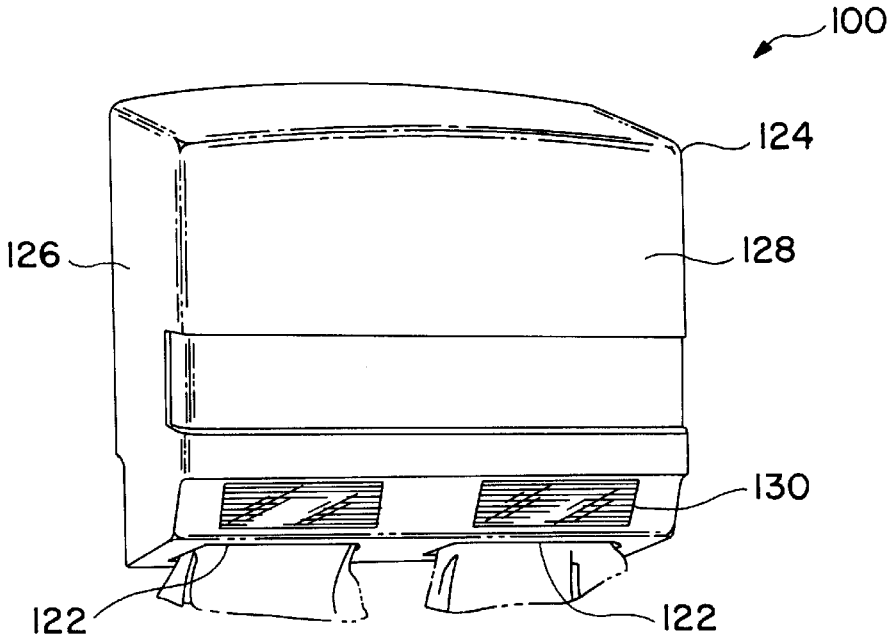
FIG. 5 is a perspective view of an alternative embodiment of a dispenser according to the invention.

FIG. 5 illustrates an additional embodiment of a dispenser 100 according to the invention configured as a dual dispenser for two supplies of folded sheets. A dispenser of this type is available from Kimberly-Clark Corporation as the SANI-TOUCH® TWIN INTERLEAVED DISPENSER (Item No. 09012). The dispenser 100 includes a cover 124 having a front panel 128 and sides 126. The cover 124 covers dual dispensing configurations that could be essentially as described above with respect to the single dispenser of FIG. 1. In other words, the dispenser 100 would include two bottom plate members 42 with associated cam members 46 for each of the dual supplies.

Any number of additional aesthetic or functional features may be included with a dispenser according to the invention. For example, a window 30,130 may be provided in any structural member of the cover 14, 124 so that the maintenance technician can easily determine the remaining level of folded sheets 12 within the dispenser 10, 100. Also, as mentioned above, the dispenser may taken on any aesthetically pleasing configuration and still incorporate the novel features of the invention.

It should be appreciated by those skilled in the art that various modifications and variations can be made to the embodiments described and illustrated herein without departing from the scope and spirit of the invention. It is intended that the invention include such modifications and variations as come within the scope of the appended claims and their equivalents.

What is claimed is:

1. A dispenser for dispensing stacked folded sheets, said dispenser comprising:

a housing configured to hold a supply of folded sheets in an internal storage space;

said housing further comprising a cover attached to stationary components of said housing and movable between an open position wherein access is provided to said internal storage space for loading folded sheets, and a closed position wherein said cover defines a front panel of said dispenser;

at least one dispensing opening defined in said housing through which folded sheets are dispensed from said internal storage space;

an overfill prevention device configured within said housing, said overfill prevention device actuated by movement of said cover from said closed position to said open position to reduce the storage space of folded sheets in said housing; and wherein said overfill prevention device comprises a bottom plate member upon which the folded sheets are stacked, said plate member having an opening therethrough aligned with said dispensing opening.

2. A dispenser for dispensing stacked folded sheets, said dispenser comprising:

a housing configured to hold a supply of folded sheets in an internal storage space;

said housing further comprising a cover attached to stationary components of said housing and movable between an open position wherein access is provided to said internal storage space for loading folded sheets, and a closed position wherein said cover defines a front panel of said dispenser;

at least one dispensing opening defined in said housing through which folded sheets are dispensed from said internal storage space;

an overfill prevention device configured within said housing, said overfill prevention device actuated by movement of said cover from said closed position to said open position to reduce the storage space of folded sheets in said housing; and wherein said overfill prevention device comprises a bottom member against which the folded sheets are stacked, said bottom member movably mounted within said housing and movable from a position generally adjacent said dispensing opening in said closed position of said cover to a position vertically displaced from said dispensing opening in said open position of said cover, said dispenser further comprising a motive member configured between said cover and said bottom member to move said bottom member upon movement of said cover.

3. The dispenser as in claim 2, wherein said bottom member comprises a plate member having an opening therethrough aligned with said dispensing opening.

4. The dispenser as in claim 2, wherein said motive member comprises at least one cam member operatively connected between said cover and said bottom member.

5. The dispenser as in claim 4, wherein said cam member is fixed relative to said cover member so as to move therewith and comprises a cam surface disposed so as to contact and move said bottom member vertically upward upon opening of said cover member.

6. The dispenser as in claim 5, further comprising two said cam members wherein one said cam member is disposed at each side of said housing below side portions of said bottom member.

7. The dispenser as in claim 5, wherein said cam member is disposed below said bottom member and has a shape so that in said closed position of said cover, said bottom member is disposed generally adjacent a bottom portion of said housing, and in said open position of said cover said cam surface engages and moves said bottom member to its vertically displaced position.

8. The dispenser as in claim 7, wherein said cam member comprises an elongated tab having said cam surface defined at an end thereof.

9. The dispenser as in claim 4, wherein said cover is pivotally mounted relative to said stationary components of said housing, said cam member being positionally fixed relative to said cover generally at a pivotal connection between said cover and said stationary housing components.

10. A dispenser for dispensing stacked folded sheets, said dispenser comprising:

a housing configured to hold a supply of folded sheets, said housing including a back panel and a bottom portion having at least one dispensing opening defined therein;

said housing further comprising a cover pivotally mounted relative to said back panel and bottom portion and movable between an open position wherein access is provided to said housing for loading folded sheets, and a closed position wherein said cover is releasably engaged with said housing and defines a front panel of said dispenser; and a bottom plate member disposed within said housing against which the folded sheets are stacked, said bottom plate member vertically movable within said housing from a position generally vertically adjacent said dispensing opening in said closed position of said cover to a position vertically displaced from said dispensing opening in said open position of said cover; and a cam member configured with said cover member and having a cam surface engaged against said bottom plate member so that said bottom plate member is moved to its vertically displaced position upon opening of said cover to reduce the storage space for folded sheets within said housing.

11. The dispenser as in claim 10, wherein said bottom plate member defines an opening aligned with said dispensing opening.

12. The dispenser as in claim 11, wherein said cam member is disposed in said housing below one of said bottom plate member side portions.

13. The dispenser as in claim 12, further comprising an additional said cam member disposed below the opposite said bottom plate member side portion.

14. The dispenser as in claim 13, wherein said cam members are fixed relative to said cover at pivotal mounts between said cover and said stationary housing components so as to pivot with said cover.

15. The dispenser as in claim 10, wherein bottom plate member is slidably engaged with said housing.

16. The dispenser as in claim 10, wherein said housing comprises an additional said dispensing opening and is configured as a dual dispenser for two supplies of folded sheets, said dispenser further comprising a said bottom plate member and associated said cam member for each said supply of folded sheets.

* * * * *